US008669495B2

(12) United States Patent
Makihira et al.

(10) Patent No.: US 8,669,495 B2
(45) Date of Patent: Mar. 11, 2014

(54) HEATER HAVING HEAT GENERATING RESISTOR ON SUBSTRATE AND IMAGE HEATING APPARATUS MOUNTING HEATER THEREON

(75) Inventors: Tomoyuki Makihira, Yokohama (JP); Masafumi Maeda, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 1845 days.

(21) Appl. No.: 11/671,309

(22) Filed: Feb. 5, 2007

(65) Prior Publication Data

US 2007/0182798 A1 Aug. 9, 2007

(30) Foreign Application Priority Data

Feb. 7, 2006 (JP) ..... 2006-030353

(51) Int. Cl.
*G03G 15/20* (2006.01)

(52) U.S. Cl.
USPC ..... 219/216; 347/156; 399/328

(58) Field of Classification Search
USPC ..... 219/216, 497; 399/45, 69
See application file for complete search history.

(56) References Cited

U.S. PATENT DOCUMENTS

| | | | | |
|---|---|---|---|---|
| 4,075,456 | A * | 2/1978 | Sakamaki et al. | 219/216 |
| 5,149,941 | A | 9/1992 | Hirabayashi et al. | 219/216 |
| 5,300,997 | A | 4/1994 | Hirabayashi et al. | 355/285 |
| 5,343,280 | A | 8/1994 | Hirabayashi et al. | 355/285 |
| 5,767,484 | A | 6/1998 | Hirabayashi et al. | 219/216 |
| 6,336,009 | B1 * | 1/2002 | Suzumi et al. | 399/67 |
| 6,438,348 | B2 | 8/2002 | Kobaru et al. | 399/333 |
| 6,469,279 | B1 * | 10/2002 | Ohtsuka | 219/216 |
| 6,516,165 | B2 | 2/2003 | Makihira et al. | 399/69 |
| 6,583,389 | B2 * | 6/2003 | Murooka et al. | 219/216 |
| 6,587,662 | B2 | 7/2003 | Kobaru et al. | 399/323 |
| 6,713,725 | B2 * | 3/2004 | Izawa et al. | 219/216 |
| 6,734,397 | B2 * | 5/2004 | Kato et al. | 219/216 |
| 6,754,458 | B2 | 6/2004 | Makihira | 399/92 |
| 2005/0258158 | A1 * | 11/2005 | Takami et al. | 219/216 |
| 2005/0280682 | A1 * | 12/2005 | Kato et al. | 347/102 |
| 2006/0000819 | A1 * | 1/2006 | Makihira et al. | 219/216 |
| 2006/0024071 | A1 * | 2/2006 | Takami | 399/33 |

FOREIGN PATENT DOCUMENTS

| | | |
|---|---|---|
| JP | 63-313182 | 12/1988 |
| JP | 5-66688 | 3/1993 |
| JP | 5-289555 | 11/1993 |
| JP | 10-177319 | 6/1998 |
| JP | 10-189218 | 7/1998 |
| JP | 10-232576 | 9/1998 |
| JP | 10-247027 | 9/1998 |
| JP | 10-301410 | 11/1998 |
| JP | 10-301411 | 11/1998 |

(Continued)

*Primary Examiner* — Brian Jennison

(74) *Attorney, Agent, or Firm* — Fitzpatrick, Cella, Harper & Scinto

(57) ABSTRACT

The heating apparatus comprises a substrate extending in one direction and a plurality of heat generating members provided on one surface of the substrate along a longitudinal direction thereof and wherein at least one of the plural heat generating members has heat generating regions having different heat generation amount per unit length in the longitudinal direction, substrate reinforcing members are provided on the other surface of the substrate in correspondence to the high heat generating regions provided on one surface of the substrate. By the virtue of the invention, cost can be reduced, emergency safety upon occurrence of overrun of a CPU can be achieved, and increase in temperature of a sheet non-passing portion can be suppressed.

11 Claims, 13 Drawing Sheets

(56) References Cited

FOREIGN PATENT DOCUMENTS

| | | |
|---|---|---|
| JP | 10-321352 | 12/1998 |
| JP | 11-16667 | 1/1999 |
| JP | 11-84919 | 3/1999 |
| JP | 11-84925 | 3/1999 |
| JP | 11-95586 | 4/1999 |
| JP | 11-190951 | 7/1999 |
| JP | 11-260533 | 9/1999 |
| JP | 2002-246160 | 8/2002 |
| JP | 2003-7435 | 1/2003 |
| JP | 2003-317898 | 11/2003 |
| JP | 2006-4860 | 1/2006 |
| JP | 2006-4861 | 1/2006 |
| JP | 2006-19159 | 1/2006 |

* cited by examiner

HEATER HAVING HEAT GENERATING RESISTOR ON SUBSTRATE AND IMAGE HEATING APPARATUS MOUNTING HEATER THEREON

BACKGROUND OF THE INVENTION

1. Field of the Invention

The present invention relates to an image heating apparatus suitable to be used as a thermal fixing apparatus mounted to an image forming apparatus such as a copier, a printer or the like, and more particularly, it relates to a heater having a heat generating resistor on a substrate, and an image heating apparatus mounting such a heater thereon.

2. Description of the Related Art

In the past, in image forming apparatuses such as electrophotographic copiers, laser beam printers and the like, a latent image corresponding to target image information was formed on an image bearing member by image forming process means, and, from the latent image, a visual image (toner image) was formed by using toner including resin having a thermally-soluble property. Then, the toner image was transferred onto a surface of a recording material such as a transferring paper, directly, or indirectly via an intermediate transferring member, thereby forming unfixed toner image on the surface of the recording material.

As a fixing apparatus for fixing the unfixed toner image onto the surface of the recording material as a permanent fixed image, a heating apparatus of heat roller type has generally been used. In such a heating apparatus, the toner image is fixed with heat and pressure by pinching and conveying the recording material as heated material by means of a fixing roller heated to a predetermined temperature and a pressure roller urged against the fixing roller.

In recent years, as described in Japanese Patent Application Laid-open No. S63-313182 (1988), a fixing apparatus of film heating type (referred to as "film heating fixing apparatus" hereinafter) for achieving power savings and for reducing time interval from ON of a power source to output of an image has been proposed and has been put to a practical use.

Such a film heating fixing apparatus comprises a heater unit as heating means, and pressurizing means such as a pressure roller (referred to merely as "pressure roller" hereinafter) for closely contacting a recording material against the heater unit. Further, the heater unit includes a heating member (referred to as "heater" hereinafter) fixedly supported, and a heat resistive film (referred to as "fixing film" hereinafter) as a flexible member conveyed while being urged against the heater. The film heating fixing apparatus serves to thermally fix the unfixed toner image formed on the surface of the recording material by applying heat from the heater to the recording material via the fixing film.

In the past, as an example of a heater attached to such a fixing apparatus, there has been proposed a heater 100 as shown in FIG. 12A. The heater 100 is fundamentally constituted by a substrate 101, and heat generating resistors 102 and 103 provided along a longitudinal direction of the substrate 101. A paper is generally conveyed along a shorter side of the substrate 101, and a longer side of the substrate is perpendicular to the conveyance direction. In this specification, a direction of the longer side is referred to as a longitudinal direction and a direction of the shorter side as the conveyance direction is referred to as a width-wise direction. In the drawings, a center of the longitudinal direction is designated by "E" and a center of the width-wise direction is designated by "F". The heat generating resistors 102 and 103 are provided along the longitudinal direction of the substrate 101. By supplying power from power supplying electrodes 104, 105 and 106 electrically communicated with both ends of the heat generating resistors 102 and 103 to the heat generating resistors 102 and 103, the heat generating resistors 102 and 13 are heated.

As shown in a graph of FIG. 12B, each of the heat generating resistors 102 and 103 of the heater 100 has a resistance value per unit longitudinal length which is uniform along the longitudinal direction.

In the film heating fixing apparatus having the heater 100 in which the heat generating resistors 102 and 103 generate the uniform heat along the longitudinal direction, the heater 100 is closely contacted with the recording material via the fixing film having a low heat capacity, thereby transmitting the heat to the recording material. Thus, on-demand fixing is permitted. However, if recording materials having widths relatively smaller than the longitudinal lengths of the heat generating resistors 102 and 103 are conveyed continuously, a difference in surface temperature between a paper passing area and a paper non-passing area of the pressure roller with which the heater is closely contacted via the fixing film becomes greater, with the result that an outer diameter and coefficient of friction of the pressure roller may be changed in the longitudinal direction of the pressure roller.

To avoid this, a heater 100 which can treat various sizes of papers and which can suppress increase in temperature of the paper non-passing area has been proposed, as disclosed in Japanese Patent Application Laid-open No. H10-177319. This heater 100 has two kinds of heaters 107 and 108 having different heat generation distributions as shown in FIG. 13A, so that, when the print is performed on a small size paper, by increasing a power supplying rate to the heat generating resistor 107 having a high resistance value at a small size paper passing area thereof, the increase in temperature of a paper non-passing area thereof can be suppressed.

Further, in recent printers, it is requested to reduce a first printout time (FPOT) which is needed from a time when print command is sent to the printer to when a first recording paper is outputted. Thus, reduction in time needed rise-up the fixing apparatus to a fixing permitting temperature is also requested, and, to cope with this, an electric power instantaneously applied to the heater becomes very great. In this case, great stress acts on the substrate of the heater. As a heater design having a great resistance against the great stress, there has been proposed a heater design in which patterns of heat generating resistors are printed symmetrically with respect to the conveyance direction of the recording material and symmetrically with respect to left and right in the longitudinal direction (see Japanese Patent Application Laid-open No. 2006-004860, Japanese Patent Application Laid-open No. 2006-004861 and US-2005-0280682).

By the way, a technique in which a reinforcing layer is provided on a substrate to reinforce the substrate is also known (see Japanese Patent Application Laid-open No. H10-189218).

However, if the reinforcing layer is provided on the whole surface of the substrate, the cost will be increased.

SUMMARY OF THE INVENTION

The present invention is made in consideration of the abovementioned problems, and an object of the present invention is to provide a heater which has resistance against stress while suppressing increase in cost, and an image heating apparatus using such a heater.

Another object of the present invention is to provide an image heating apparatus, comprising: a heater including a substrate, at least two first heat generating resistors and at least one second heat generating resistor formed on the substrate along a longitudinal direction thereof, the second heat generating resistor being provided between the first heat generating resistors in a direction of a shorter side of the substrate; wherein the second heat generating resistor includes a first region having a low resisting value per unit length and a second region having a resisting value per unit length greater than that of the first region; a first switching element, which is connected electrically between a power source and the first heat generating resistors, for controlling an electrical power supply to the first heat generating resistors; and a second switching element, which is connected electrically between the power source and the second heat generating resistor, for controlling an electrical power supply to the second heat generating resistor; and wherein the substrate has a substrate reinforcing layer only along a portion of the longitudinal direction in a surface opposite to a surface on which the first and second heat generating resistors are provided, and, an area of the substrate reinforcing layer regarding the longitudinal direction includes the second region of the second heat generating resistor.

A further object of the present invention is to provide a heater comprising a substrate; at least two first heat generating resistors formed on the substrate along a longitudinal direction thereof; and at least one second heat generating resistor formed on the substrate along a longitudinal direction thereof, the second heat generating resistor being provided between the first heat generating resistors in a direction of a shorter side of the substrate; wherein the second heat generating resistor includes a first region having a low resisting value per unit length and a second region having a resisting value per unit length greater than that of the first region; and wherein the substrate has a substrate reinforcing layer only along a portion of the longitudinal direction in a surface opposite to a surface on which the first and second heat generating resistors are provided, and, an area of the substrate reinforcing layer regarding the longitudinal direction includes the second region.

Further features of the present invention will become apparent from the following description of exemplary embodiments with reference to the attached drawings.

BRIEF DESCRIPTION OF THE DRAWINGS

FIG. 3A is a schematic plan view of a front surface side of the heater, FIG. 3B is a schematic plan view of the front surface side of the heater, with a surface protecting layer omitted, FIG. 3C is a schematic plan view of a rear surface side of the heater, and FIG. 3D is a schematic plan view of a central portion of the heater in a width-wise direction thereof.

FIG. 4A is a schematic plan view of a front surface side of the heater, FIG. 4B is a view showing heat generation distribution in a longitudinal direction, FIG. 4C is a view showing a section of the heater taken along the line α-α in FIG. 4A and heat generation distribution and FIG. 4D is a view showing a section of the heater taken along the line β-β in FIG. 4A and heat generation distribution.

FIG. 6A shows a case in which high resistance regions (second regions) of a second heat generating resistor 32 are positioned at longitudinal end portions of a substrate and FIG. 6B shows a case in which a high resistance region (second region) of a second heat generating resistor 32 is positioned at a central portion of the substrate.

FIG. 11A is a schematic plan view of a front surface side of the heater, FIG. 11B is a view showing a section of the heater taken along the line 11B-11B in FIG. 11A and heat generation distribution, FIG. 11C is a view showing a section of the heater taken along the line 11C-11C in FIG. 11A and heat generation distribution, and FIG. 11D is a view showing a section of the heater taken along the line 11D-11D in FIG. 11A and heat generation distribution.

DESCRIPTION OF THE EMBODIMENTS

Now, heaters and image heating apparatuses according to the present invention will be fully explained with reference to the accompanying drawings.

First Embodiment

Figure 1:
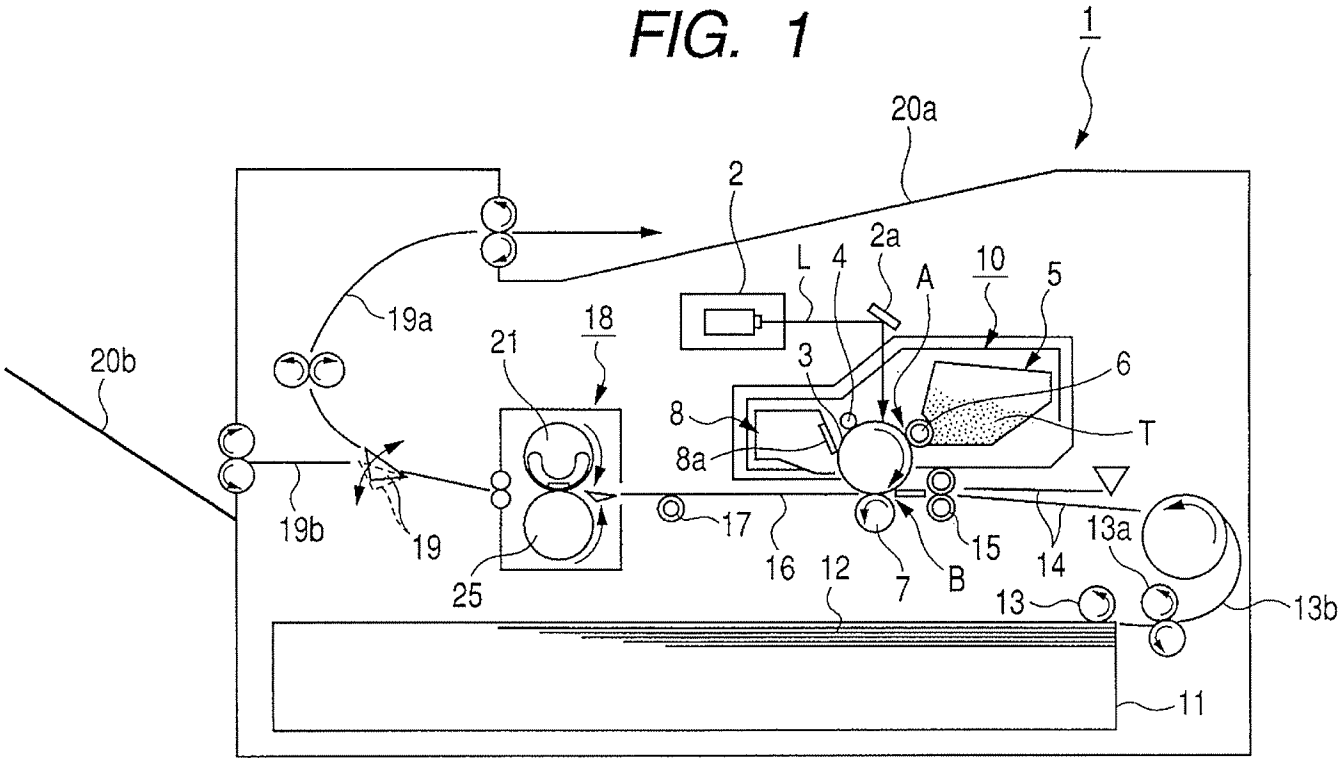
FIG. 1 is a schematic sectional view of an image forming apparatus to which an image heating apparatus according to the present invention is mounted.

FIG. 1 shows a schematic construction of an image forming apparatus having an image heating apparatus according to an embodiment of the present invention. In this embodiment, the image forming apparatus is an electrophotographic laser beam printer. Hereinbelow, a whole construction of the laser beam printer will be described.

(1) Whole Construction of Image Forming Apparatus

In FIG. 1, an image forming apparatus 1 according to this embodiment comprises a scanner unit 2 as exposure means for illuminating and scanning a laser beam L emitted in response to image information.

Further, the image forming apparatus 1 includes a process cartridge 10 removably mounted to a main body of the image forming apparatus. The process cartridge 10 incorporates main image forming means therein. Namely, the process cartridge 10 includes an electrophotographic drum-shaped photosensitive member (referred to as "photosensitive drum" hereinafter) 3 as an image bearing member, and a roller charger 4 formed from semi-conductive rubber and acting as charging means. Further, in the illustrated embodiment, the process cartridge includes a developing apparatus 5 as developing means for developing a latent image formed on the photosensitive drum 3, and a cleaner 8 as cleaning means having a cleaning blade 8*a* for removing toner from the photosensitive drum 3 after transferring.

With the arrangement as mentioned above, the photosensitive drum 3 within the process cartridge 10 is rotated in a clockwise direction shown by the arrow, and a surface of the photosensitive drum is uniformly rectified or charged by the roller charger 4. A laser beam L emitted from the scanner unit 2 is illuminated onto the uniformly charged surface of the photosensitive drum 3 via a mirror 2*a*, thereby an electrostatic latent image on the surface of the photosensitive drum 3. Toner is supplied to the electrostatic latent image by means of a developing roller 6 disposed within the developing apparatus 5 and acting as developer bearing means for bearing and conveying developer T to a developing area A, thereby visualizing the latent image as a toner image. In the illustrated embodiment, while magnetic one-component developer (referred to as "toner" hereinafter) T was used, the present invention is not limited to such developer.

On the other hand, transferring materials (having a weight of 64 to 128 grams) 12 as recording materials contained within a sheet supplying cassette 11 are separated one by one by means of a sheet supplying roller 13 and a pair of separation rollers 13*a* and are supplied successively. The supplied transferring material 12 is reversely rotated (turned over) in a U-turn sheet path 13*b* and then is conveyed to a pair of registration rollers 15 along upper and lower guides 14. The registration rollers 15 are stopped until the transferring material 12 reaches thereto, so that a leading end of the transferring material 12 abuts against a nip portion of the registration rollers, thereby correcting skew-feed of the transferring material 12.

Then, the registration rollers 15 convey the transferring material 12 up to a transferring portion B as contact nip portion between the photosensitive drum 3 and a transferring roller 7 as transferring means, in synchronous with a leading end of the image formed on the photosensitive drum 3. Incidentally, a sheet supplying sensor (not shown) is disposed in the vicinity of the pair of registration rollers 15 to detect a paper passing condition, sheet jam and a length of the transferring material.

Charges having polarity opposite to that of the toner are applied from the transferring roller 7 to the transferring material 12 conveyed to the transferring portion B in this way, from a rear side of the transferring material, with the result that the toner image formed on the photosensitive drum 3 is transferred onto the transferring material 12.

The transferring material 12 to which the toner image was transferred is conveyed to a fixing apparatus 18 by a conveying guide 16 and a conveying roller 17. The fixing apparatus 18 serves to fuse the unfixed toner image formed on the transferring material 12 and fix the fused image onto the transferring material 12, by heat and pressure, thereby forming a recorded image.

After the image was fixed, when an image facing down discharge mode is set, the transferring material 12 is guided toward a U-turn sheet path 19*a* by a flapper 19 and then is discharged onto a first discharge tray 20*a*. On the other hand, when an image facing-up discharge mode is commanded, the transferring material is guided toward a straightforward sheet path 19*b* by the flapper 19 and then is discharged onto a second discharge tray 20*b*.

Here, in the image forming apparatus according to the illustrated embodiment, the transferring material is conveyed in such a manner that a width-wise center of the transferring material coincides with a width-wise center of the conveying path.

(2) Fixing Apparatus 18

Figure 2:
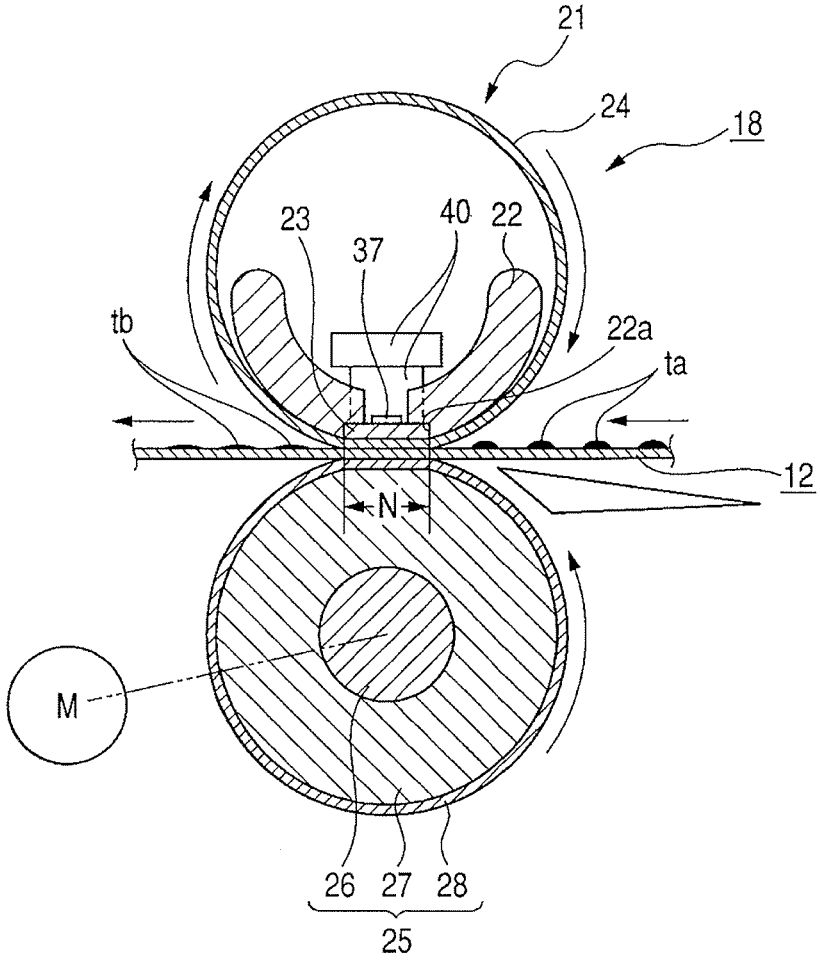
FIG. 2 is a schematic sectional view of a film heating fixing apparatus as an embodiment of the image heating apparatus of the present invention.

Next, the fixing apparatus 18 will be described with reference to FIG. 2. The fixing apparatus 18 according to the illustrated embodiment is a heating apparatus of tensionless film heating type which is driven by a pressure roller.

(a) Whole Construction of Fixing Apparatus 18

In the illustrated embodiment, the fixing apparatus 18 includes a heater unit 21 as heating means, and an elastic pressure roller 25 as pressurizing means.

The heater unit 21 includes a heat-resistive stay holder 22 as a heating member support. The stay holder 22 is a heat-resistive member of trough type having a substantially semi-circular cross-section. A groove 22*a* is formed in a lower surface of the stay holder 22 along a longitudinal direction thereof, and a heating member (referred to as "heater" hereinafter) 23 is fitted into the groove 22*a* and fixedly supported therein. A structure of the heater 23 will be explained in an item (b) which will be described later.

A cylindrical thin film (referred to as "fixing film" hereinafter) 24 as a flexible sleeve made of material mainly including polyimide or the like having excellent heat resistance is loosely mounted around the stay holder 22 fixedly supporting the heater 23.

In the illustrated embodiment, the heater unit 21 is constituted by, at least, the stay holder 22, heater 23 and fixing film 24.

In the fixing apparatus 18 according to the illustrated embodiment, the heater 23 and a pressure roller 25 are urged against each other with the interposition of the fixing film 24, by an urging force of a pressurizing member (not shown), in opposition to the elasticity of the pressure roller 25. In this way, a heating nip portion N having a predetermined width required for thermal or heat fixing.

The pressure roller 25 is constructed by forming an elastic layer 27 such as a silicone rubber around a metal core 26, and a tube made of PFA or PTFE having an excellent mold releasing ability is coated on the elastic layer to form a mold releasing layer 28.

In the illustrated embodiment in which the pressure roller driving system is used, the pressure roller 25 is rotatingly driven in an anti-clockwise direction shown by the arrow by means of drive means M. Due to the rotational driving of the pressure roller 25, a contact friction force at the heating nip portion N between the pressure roller 25 and an outer surface of the fixing film 24 provides a rotational force to the cylindrical fixing film 24. As a result, the fixing film 24 is rotated in a clockwise direction shown by the arrow around the stay holder 22 in such a manner that an inner surface of the film is closely contacted with and slid against a lower surface of the heater 23.

The fixing film 24 is rotated by the rotational driving of the pressure roller 25, and, as will be described later, a temperature of the heater 23 is increased to a predetermined temperature-adjusted target temperature by applying power to the heater 23. In this condition, the transferring material (recording material) 12 bearing the unfixed toner image ta thereon is introduced into the heating nip portion N between the fixing film 24 and the pressure roller 25. Consequently, the transferring material is passed through the heating nip portion N together with the fixing film 24 in a condition that the toner image on the transferring material is closely contacted with the outer surface of the fixing film 24. Accordingly, heat from the heater 23 is applied to the transferring material 12 via the fixing film 24, with the result that the unfixed toner image ta is thermally fixed onto the surface of the transferring material 12, thereby obtaining a fixed image tb. After passed through the heating nip portion N, the transferring material 12 is separated from the surface of the fixing film 24 and then is conveyed and discharged.

The stay holder 22 serves to act as a support member for the heater 23 and also to achieve pressurizing at the heating nip portion N and stability of rotational conveyance of the cylindrical fixing film 24.

The fixing film 24 is rotated in such a manner that the inner surface of the film is slid on the lower surface of the heater 23 at the heating nip portion N and is slid on the outer surface of the stay holder 22 in the vicinity of the heating nip portion N. In order to rotate the fixing film 24 smoothly with low torque, friction resistances between the heater and the stay holder 22, and the fixing film 24, must be suppressed to smaller values. To this end, a small amount of lubricant such as heat-resistive grease is provided between the heater 23 and the fixing film 24 and between the stay holder 22 and the film. In this way, the fixing film 24 can be rotated smoothly.

The fixing film 24 is a member having a small heat capacity, and, in order to permit quick start, this film has a thickness smaller than 100 μm and is made of material having a heat resistance ability and a thermoplastic property, such as polyimide, polyamideimide, PEEK, PES, PPS, PFA, PTFE, FEP or the like. Further, in order to obtain a fixing apparatus having a long service life, the film must have a thickness greater than 20 μm to provide sufficient strength and excellent endurance. Accordingly, the thickness of the fixing film 24 is optimum between 20 μm and 100 μm. Further, in order to prevent offset and to ensure the separation of the recording material, heat-resistive resin such as PFA, PTFE, FEP or silicone resin having a good mold releasing ability is mixed with or coated on a surface layer of the fixing film 24.

Image forming apparatuses such as printers, copiers and the like using such a fixing apparatus of film heating type have various advantages in comparison with conventional image forming apparatuses of the type in which thermal fixing is performed by using the heat roller. Namely, by using the fixing apparatus of film heating type, since a heating efficiency is enhanced and a rising-up speed is increased, preliminary heating during a waiting condition is not needed and a waiting time can be reduced.

(b) Heater 23

Figure 3A:
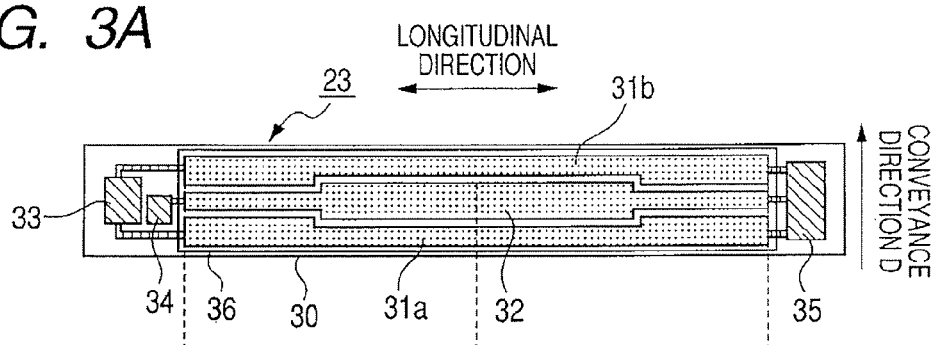
FIGS. 3A, 3B, 3C and 3D are constructional views of a heater of the present invention, where
Figure 3B:
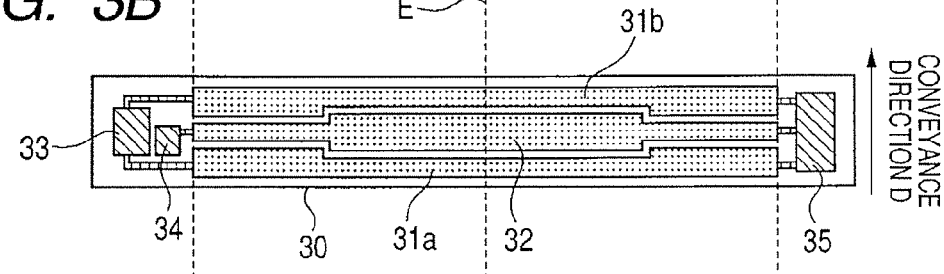
Figure 3C:
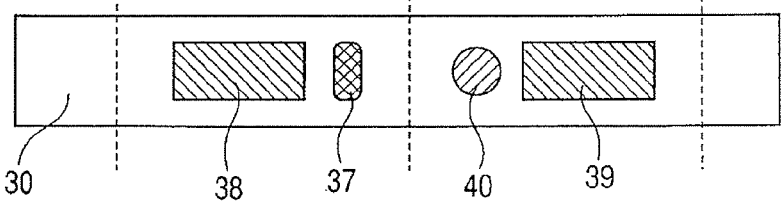
Figure 3D:
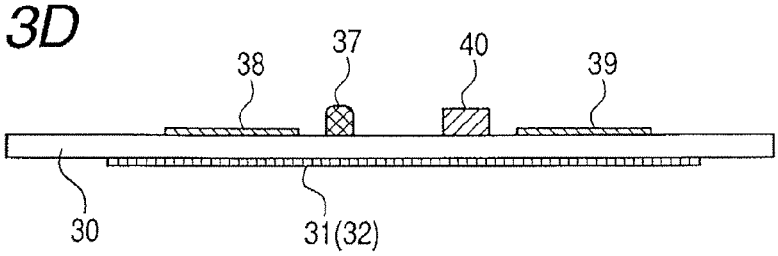

FIG. 3A is a schematic plan view of a front surface side of the heater, showing configurations of heat generating resistors at a sheet passing surface of the heater, and FIG. 3B is a schematic plan view of the front surface side of the heater, showing the configurations of the heat generating resistors at the heater, with a glass layer as a protection layer omitted from the sheet passing surface of the heater. Further, FIG. 3C is a schematic plan view of a rear surface side or sheet non-passing surface side of the heater, and FIG. 3D is a central sectional view of the heater in a width-wise direction, where an upper side of FIG. 3D is a heat non-generating side and a lower side is a heat generating side.

The heater 23 includes an elongated heater substrate 30 extending in one direction. The heater substrate 30 is made of a ceramic material such as alumina, aluminum nitride or the like having good heat-resistance, good thermal conductivity and good electrical insulation and is an elongated thin plate-shaped member having a longitudinal direction transverse (perpendicular) to a conveyance direction D of the recording material.

First heat generating resistors (i.e. main heaters) 31 (31*a* and 31*b*) and a second heat generating resistor (i.e. sub-heater) 32, which can generate heat by power supplying, are formed on a front surface of the heater substrate 30 along the longitudinal direction thereof, by a thick film printing technique.

The main heaters 31 (31*a* and 31*b*) and the sub-heater 32 are formed along the longitudinal direction of the heater substrate 30 and are arranged along the recording material conveyance direction D (perpendicular to the longitudinal direction of the heater substrate 30).

A power supplying electrode (referred to as "main contact" hereinafter) 33 is provided at longitudinal one ends of the main heaters, and a power supplying electrode (referred to as "sub-contact" hereinafter) 34 is provided at a longitudinal one end of the sub-heater 32. Further, a common power supplying electrode (referred to as "common contact" hereinafter) 35 is provided at the other longitudinal ends of the main heaters 31 and the sub-heaters 32.

All of the main contact 33, sub-contact 34 and common contact 35 are formed as conductor patterns on the surface at both end portions of the heater substrate 30 by a thick film printing technique.

A surface protection layer 36 is formed on the surface of the heater substrate 30 to cover or coat the main heaters 31, sub-heater 32, a part of main contact 33, a part of sub-contact 34 and a part of common contact 35. The surface protection layer 36 is formed as a glass coat pattern by a thick film printing technique. The inner surface of the fixing film 24 is slidingly and closely contacted with the surface of the surface protection layer 36.

The heater 23 includes a temperature detecting element 37 such as a thermistor provided on a rear surface side of the heater substrate 30. In the illustrated embodiment, the temperature detecting element 37 is a thermistor which is urged against the rear surface of the heater substrate 30 with constant pressure at a position within a sheet passing area of a smallest side recording material.

Further, a safety element 40 such as a thermo-switch or a thermo-fuse is also provided. In the illustrated embodiment, a thermo-switch is used as the safety element 40. The thermo-switch 40 is contacted with the rear surface of the heater substrate 30 at a position (longitudinal central portion of a heat generating area of the heater 23) substantially corresponding to a central reference line E as recording material conveyance reference.

The heater 23 further includes substrate reinforcing members (substrate reinforcing layers) 38 and 39, and, in the illustrated embodiment, the substrate reinforcing members 38 and 39 are formed from silver paste having high thermal conductivity.

Incidentally, it is preferable that the substrate reinforcing members 38 and 39 have one of strength, elasticity, ductility and plasticity which are greater than those of the substrate, or any combination thereof. The substrate reinforcing members 38 and 39 will be fully described later.

Figure 7A:
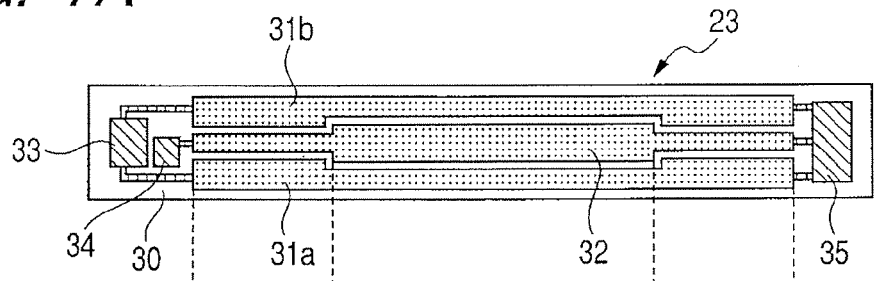
FIGS. 7A and 7B are schematic plan views of the rear surface side of the heater, showing coating areas of a reinforcing layer.

In the illustrated embodiment, main heaters 31 (31*a* and 31*b*) and the sub-heater 32 have different heat generation distributions along the longitudinal direction. Each of the main heaters 31 has a resistor pattern having heat generation distribution in which a heat generation amount at a central portion is greater than a heat generation amount at each end portion in the longitudinal direction, and the sub-heater a resistor pattern having heat generation distribution in which a heat generation amount at a central portion is smaller than a heat generation amount at each end portion in the longitudinal direction. In other words, the heater 23 includes the substrate 30, at least two first heat generating resistors 31 and at least one second heat generating resistor 32. Further, the second heat generating resistor 32 is disposed between the first heat generating resistors 31*a* and 31*b* in the width-wise direction of the substrate. Further, the second heat generating resistor has a first region (area Y in FIG. 7) having a low resistance value per unit length and second regions (areas Z in FIG. 7) each having a resistance value per unit length greater than that of the first region. Further, in the illustrated embodiment, the main heaters 31*a* and 31*b* are arranged symmetrically with respect to a central line of the substrate in the width-wise direction thereof.

A heat generation amount of the heater 23 used in the illustrated embodiment is shown in FIG. 4. FIG. 4A is a schematic plan view of the front surface side of the heater, FIG. 4B is a view showing heat generation distribution in the longitudinal direction, FIG. 4C is a view showing a section of the heater at a position taken along the line 4C-4C in FIG. 4A heat generation distribution, and FIG. 4D is a view showing a section of the heater at a position taken along the line 4D-4D in FIG. 4A heat generation distribution.

When it is assumed that a heat generation amount of a central portion of each of two main heaters 31*a* and 31*b* is Qa, a heat generation amount Qb at each end portion will be Qb=½Qa. A heat generation amount of a central portion of the sub-heater 32 is Qa which equals to that of the central of each main heater 31, and a heat generation amount Qc at each end portion of the sub-heater becomes Qc=2Qa. Accordingly, when the power is supplied to the main heaters 31 (31*a* and 31*b*) and the sub-heater 32 simultaneously, heat generation amount becomes substantially uniform (3Qa) through the longitudinal direction of the heat generating resistors.

Figure 5:
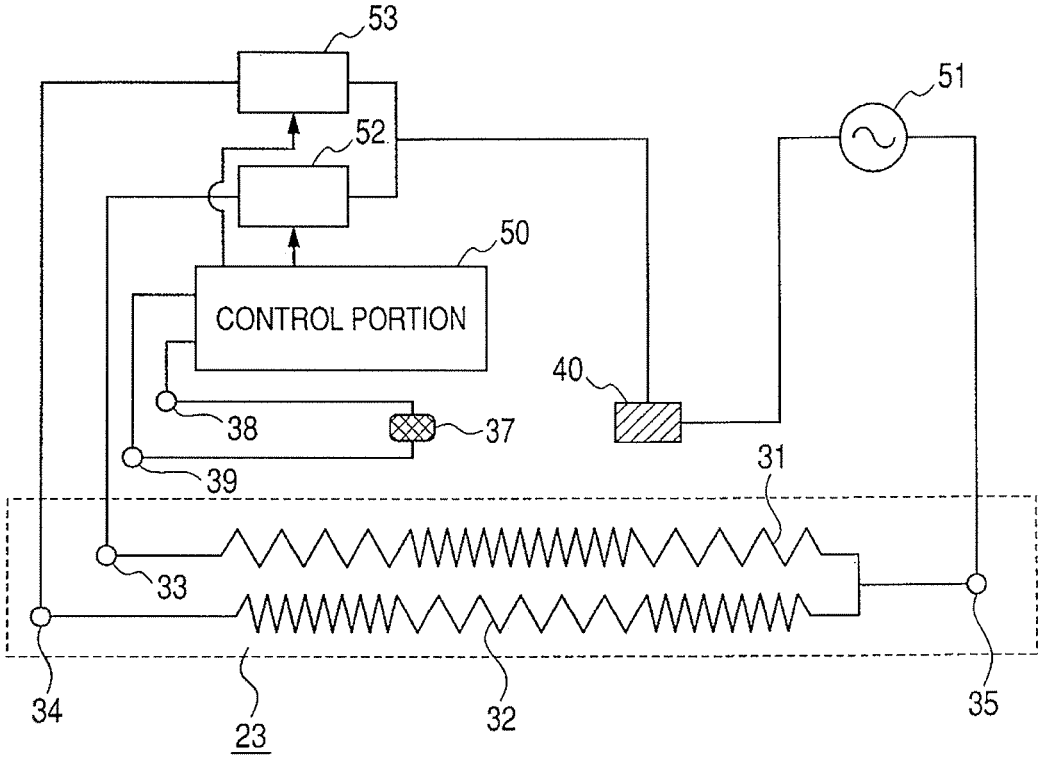
FIG. 5 is a block diagram showing a power supplying circuit and a control circuit for the heater.

FIG. 5 is a block circuit diagram of a power supplying control system for the heater 23. In the illustrated embodiment, the power supplying control system includes a control portion (engine controller, CPU) 50, an AC power source 51, and first and second triacs 52 and 53.

With this arrangement, the power supplying control system constitutes the following two power supplying paths, i.e. Line 1 and Line 2.

Line 1: AC power source 51→thermo-switch 40→first triac (first switching element) 52→main contact 33→main heaters 31→common contact 35→AC power source 51; Line 2: AC power source 51→thermo-switch 40→second triac (second switching element) 53→sub-contact 34→sub-heater 32→common contact 35→AC power source 51.

The control portion 50 controls the first and second triacs 52 and 53 to control the power supplying to the main heaters 31 and the sub-heater 32.

Further, temperature information of the heater 32 detected by the thermistor 37 is fed-back to the control portion 50 as a digital signal.

The control portion 50 controls the first and second triacs 52 and 53 on the basis of the heater temperature detection information fed-back from the thermistor 37 to control the main heaters 31 and the sub-heater 32 so that the temperature of the heater is temperature-adjusted and maintained to a predetermined target temperature.

Further, the control portion controls the first and second triacs 52 and 53 in accordance with size information of the recording material 12 to be passed to control power supplying rates to the main heaters 31 and the sub-heater 32.

Even if the power supplying to the heater 23 is performed in an uncontrolled and continuous manner (thermal overrun) due to malfunction of the control portion 50, the thermo-switch 40 as the safety element will detect (temperature detection) excessive increase in temperature of the heater 23, thereby stopping the power supplying to the heater 23 promptly.

With the heater 23 having the above-mentioned construction, by energizing the main heaters 31 mainly when the recording material having a small size is passed, the temperature of the sheet non-passing portion can be prevented from being increased and the number of recording materials or sheets to be passed within a predetermined time period can be increased. Further, wrinkles of the sheet and glossy unevenness of the image which would be caused by the deformation of the pressure roller generated due to the thermal expansion of the sheet non-passing area of the pressure roller can also be prevented.

Now, regarding the heater 23, the heat generation distribution in the longitudinal direction and the heat generation distribution in the conveyance direction will be described with reference to FIG. 4.

Figure 4A:
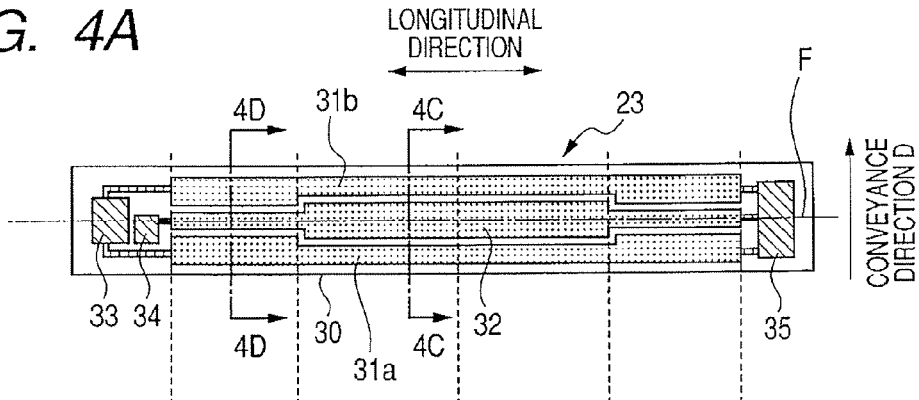
FIGS. 4A, 4B, 4C and 4D are views showing heat generation distributions of the heater of the present invention, where
Figure 4B:
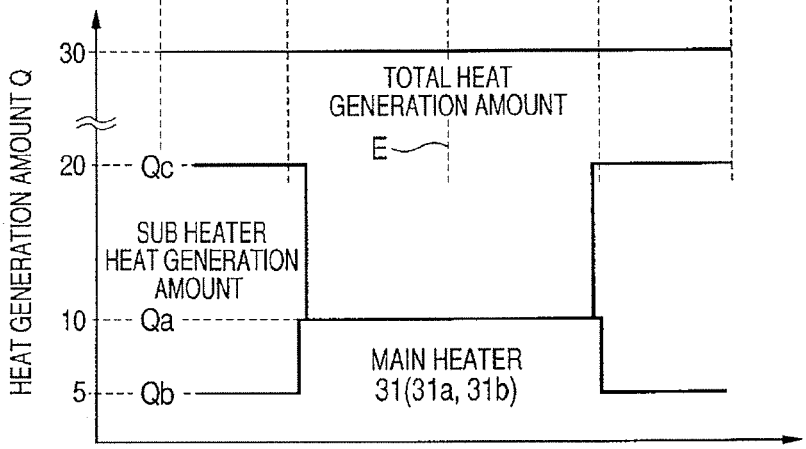

As shown in FIG. 4B, the heat generation distribution in the longitudinal direction is symmetrical in the left-and-right direction with respect to the longitudinal center pf the substrate. Further, as shown in the sectional views taken along the lines 4C-4C and 4D-4D of FIGS. 4C and 4D, the heat generation distribution in the recording material conveyance direction D is symmetrical with respect to the widthwise (conveyance direction) center F of the substrate at any longitudinal position. Such symmetrical heat generation distributions can suppress thermal stress applied to the substrate 30 during the thermal overrun, as small as possible.

However, even when the heat generating resistors are printed so as to achieve such symmetrical heat generation distributions, if abrupt electric power is applied to the heater during the thermal overrun, there is a danger of generating a heater crack phenomenon before the thermo-switch 40 is operated.

Figure 4C:
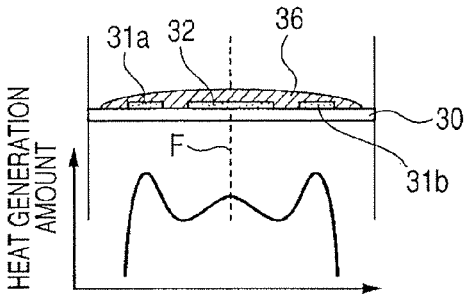
Figure 4D:
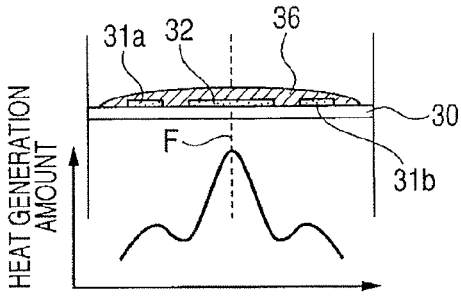

In the heater 23 as described in the illustrated embodiment, as shown in FIGS. 4C and 4D, a configuration of the heat generation distribution in the conveyance direction is changed in accordance with the longitudinal position. Considering the thermal stress generated in the substrate 30, in comparison with a case where a high heat generating region is positioned at the center F of the substrate, when high heat generating regions are positioned at edge portions of the substrate in the conveyance direction (width-wise direction) thereof, since the expansion of the substrate is flexible, less thermal stress acts on the substrate not to crack the heater.

Figure 6A:
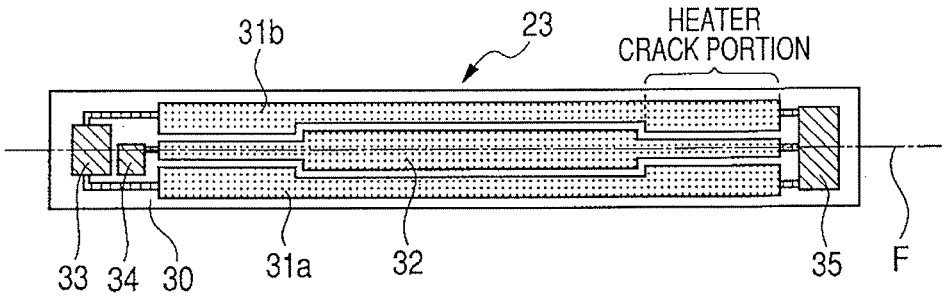
FIGS. 6A and 6B are views showing a heater crack portion generated if a reinforcing layer is not provided, where
Figure 6B:
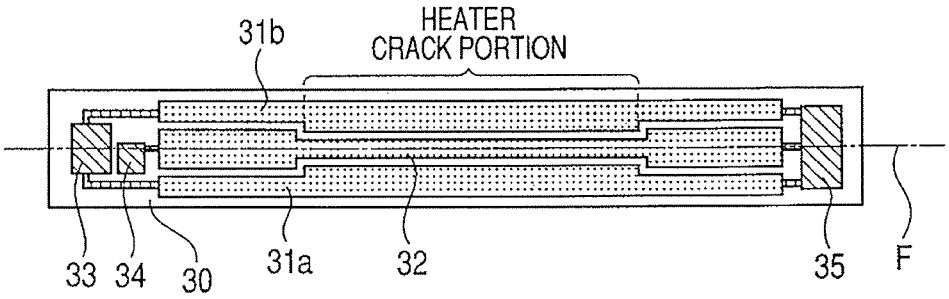

In fact, in the illustrated embodiment, if excessive electric power is supplied to cause the thermal overrun, the substrate 30 is cracked at a position corresponding to the section β-β, rather than the section α-α. Further, when heaters as shown FIGS. 6A (the embodiment of the present invention) and 6B (the other heater) were manufactured and the thermal overrun was caused to apply the thermal stress to the heaters, it was found that the crack portions (positions) correspond to areas where high heat generating regions are positioned at the center F of the substrate. That is to say, in case of FIG. 6A, since the high heat generating regions (second regions) of the second heat generating resistor 32 positioned at the width-wise center of the substrate are located at both longitudinal side portions of the substrate, cracks of the substrate are generated at these both side areas. In case of FIG. 6B, since the high heat generating region (second region) of the second heat generating resistor 32 positioned at the width-wise center of the substrate is located at the longitudinal center of the substrate, crack of the substrate is generated at this central area.

From the above, it was found that, if the high heat generating region is located at the center F in the conveyance direction of the substrate, the heater is cracked at this region.

Figure 7B:
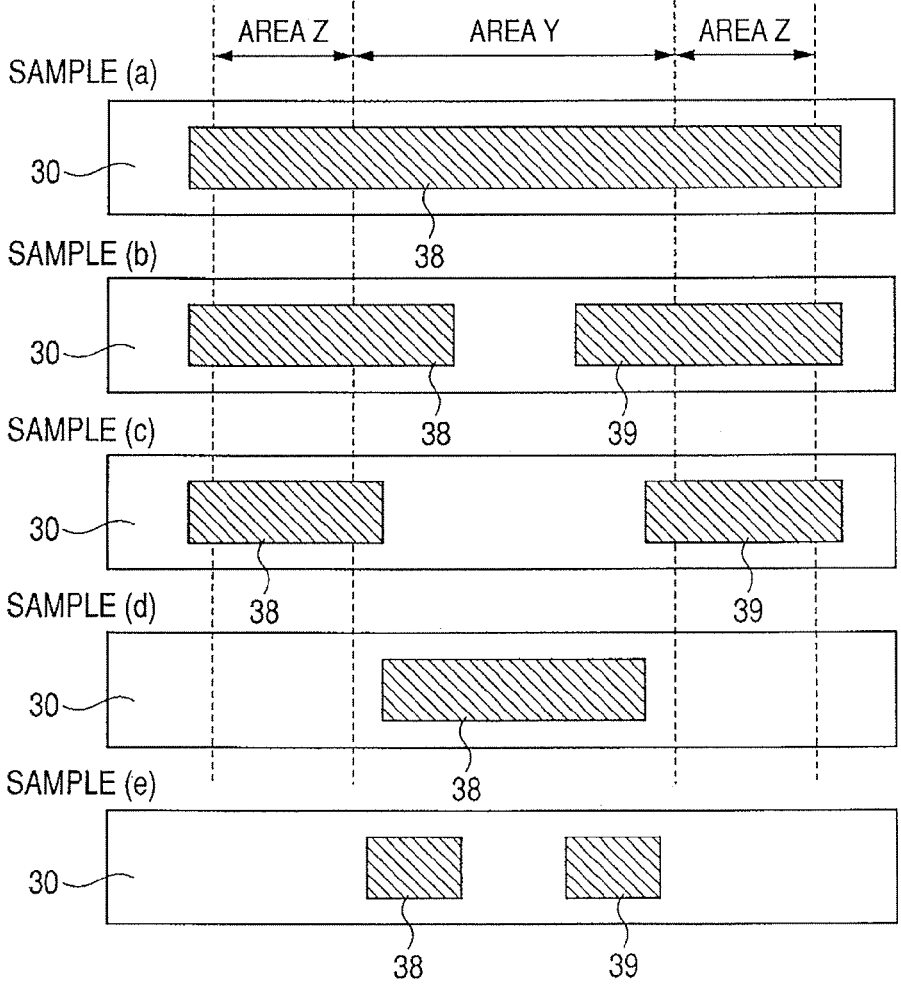

To avoid this, as shown in Samples (a) to (e) of FIG. 7B, silver paste as the substrate reinforcing members (substrate reinforcing layers) 38 and 39 was coated on a heat generating resistor non-existing side (surface on which the heat generating resistors are not formed) of the heater. As a result, it was found that, by coating the silver paste, having conductivity greater than that of the substrate, on the area where the high heat generating regions are located among the center F of the conveyance direction of the substrate 30, a time period up to the occurrence of the heater crack can be extended. By using such countermeasure, a time period up to the start of operation of the thermo-switch 40 can be reserved, with the result that the power supplying to the heater can be stopped before the heater is cracked. Incidentally, in these tests, it was set so that the thermo-switch 40 is not operated, and time periods spent between a time when an electric power of 3000 W in total was supplied to the first heat generating resistors 31 and the second heat generating resistor 32 and a time when the heater substrate was cracked were measured.

Test results are shown in the following Table 1.

TABLE 1

| Supplied power 3000 W | | |
|---|---|---|
| Silver paste coating shape | Crack time (sec) | Crack position |
| Sample (a) | 4 | Between Y–Z |
| Sample (b) | 4 | Between Y–Z |
| Sample (c) | 3.8 | Between Y–Z |
| Sample (d) | 2.1 | Y |
| Sample (e) | 2.2 | Y |

In the Samples (d) and (e), the silver paste coating area on the heater is not the high heat generating regions (areas Z) but the low heat generating region (area Y) of the second heat generating resistor 32. Thus, in comparison with the Samples (a), (b) and (c) in which the silver paste was coated on the areas Z, the time period spent between the time when the electric power of 3000 W was supplied to the heater and the time when the heater substrate was cracked is very short. Accordingly, there is the great possibility that the heater is cracked before the thermo-switch 40 is operated.

Further, as can be seen from the comparison between the Samples (a), (b) and (c), even when the silver paste was coated on the whole rear surface of the heater (Sample (a)) and even when the coating area was limited (Samples (b) and (c)), the time periods spent till the heater is cracked are substantially the same. From the above, as is in the Samples (b) and (c), by coating the expensive silver paste only on the areas where the high heat generating regions are located among the center of the conveyance direction of the substrate 30, it is possible to reinforce the heater substrate 30 effectively with a small amount of silver paste. That is to say, the substrate 30 may be constructed so that it includes the substrate reinforcing layers 38 and 39 disposed only on a part of the longitudinal direction of the substrate in the surface opposite to the surface on which the first and second heat generating resistors 31 and 32 are provided and that the substrate reinforcing layers are coated on areas including the second areas Z of the second heat generating resistor 32 with respect to the longitudinal direction of the substrate. In particular, as is in the Sample (c), it is more preferable that the coating area of the substrate reinforcing layers includes the second areas Z of the second heat generating resistor 32 and slightly extends from the areas Z (a penetrating amount into the area Y is 1 cm or less).

From the above explanation, by coating a small amount of silver paste having high thermal conductivity on the area(s) including the high heat generating region(s) among the center of the conveyance direction of the substrate 30 effectively, the heater crack during the thermal overrun can be prevented with low cost.

Figure 8A:
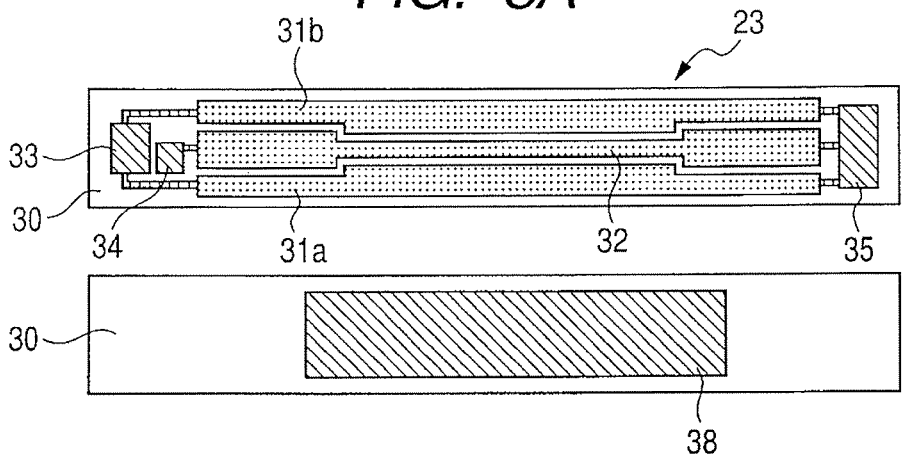
FIGS. 8A, 8B and 8C are views for explaining reinforcing layer arranging areas in various heaters having different heat generating resistor configurations.
Figure 8B:
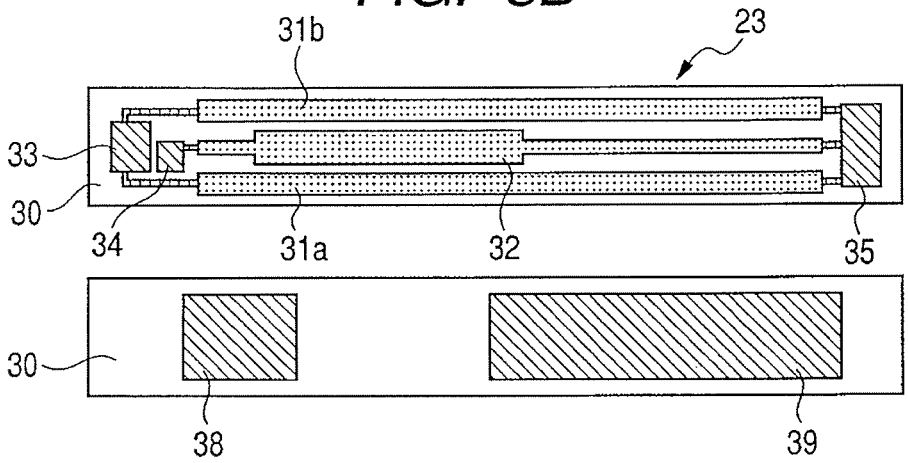
Figure 8C:
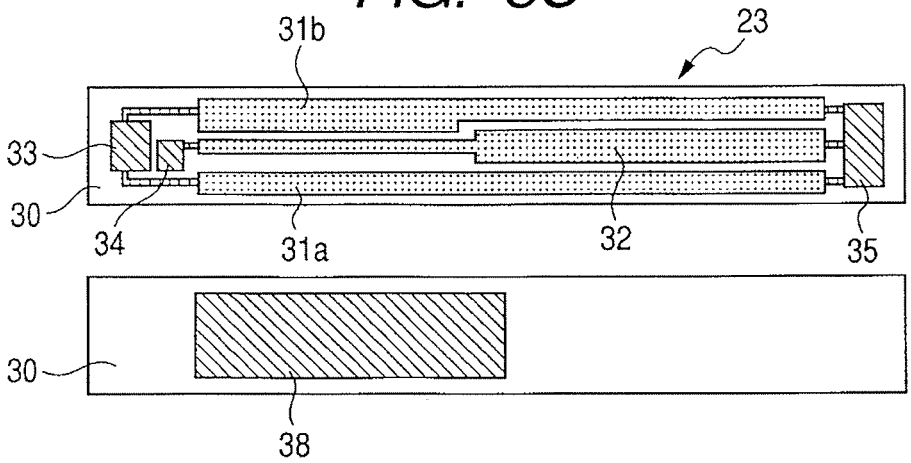

Further, FIGS. 8A, 8B and 8C show heaters 23 having special heat generating resistor patterns. In these Figures, an upper side shows the heat generating resistor pattern and a lower side shows reinforcing member(s).

Namely, also in FIGS. 8A, 8B and 8C, each heater 23 is the same as, for example, the heater 23 shown in FIG. 4 in the point that the heater comprises first heat generating resistors 31 (31*a* and 31*b*) and a second heat generating resistor 32. However, unlike to the heat generating pattern of the heater 23 shown in FIG. 4, in FIG. 8A, the second heat generating resistor 32 disposed at the width-wise center of the substrate has smaller heat generation amount regions at both longitudinal end portions of the substrate, and each of the first heat generating resistors 31 (31*a* and 31*b*) disposed on both sides in the width-wise direction of the substrate has greater heat generation amount regions at both longitudinal end portions of the substrate.

Further, in FIG. 8B, the second heat generating resistor 32 disposed at the width-wise center of the substrate has asymmetrical heat generation distribution with respect to the longitudinal center of the substrate, and the heat generation amount of each of the first heat generating resistors 31 (31*a* and 31*b*) disposed on both sides in the width-wise direction of the substrate is uniform along the longitudinal direction.

Further, in FIG. 8C, the second heat generating resistor 32 disposed at the width-wise center of the substrate has a greater heat generation amount region at one longitudinal end portion of the substrate, and one of the first heat generating resistors 31*a* has a greater heat generation amount region at one longitudinal end portion opposite to that of the heat generating resistor 32, and the heat generation amount of the other first heat generating resistor 31*b* is uniform along the longitudinal direction.

In this way, also in the special heat generating resistor patterns as shown in FIGS. 8A, 8B and 8C, by coating the silver paste having high thermal conductivity, i.e. substrate reinforcing members 38 and 39 on the area(s) including the high heat generating region(s) among the center of the conveyance direction of the substrate, similar effects can be achieved.

Second Embodiment

Next, a second embodiment of the present invention will be explained. According to this second embodiment, in a heater comprising three heat generating resistors and in which and heat generation amounts of the heat generating resistors are changed continuously, thicknesses of substrate reinforcing members disposed on a rear surface of the heater are varied along the longitudinal direction (Namely, the thickness of the substrate reinforcing layer is changed in accordance with a resistance value per unit length of the second heat generating resistor). With this arrangement, the increase in temperature of the sheet non-passing portion of the heater can be prevented and, at the same time, the heater crack during the thermal overrun can be prevented.

Figure 9A:
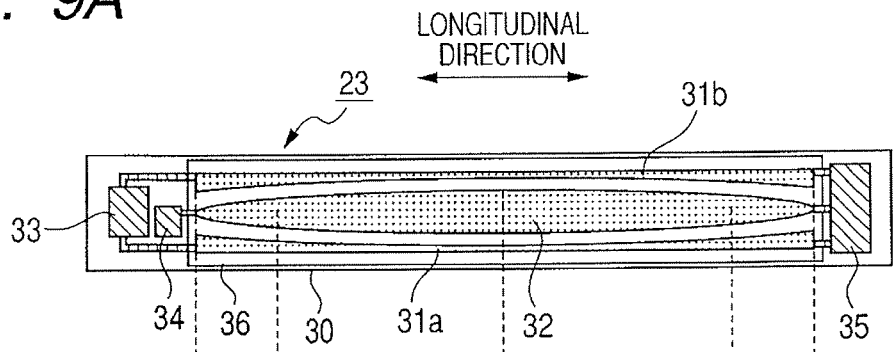
FIGS. 9A, 9B, 9C, and 9D are views for explaining a construction of a heater according to a second embodiment of the present invention.
Figure 9B:
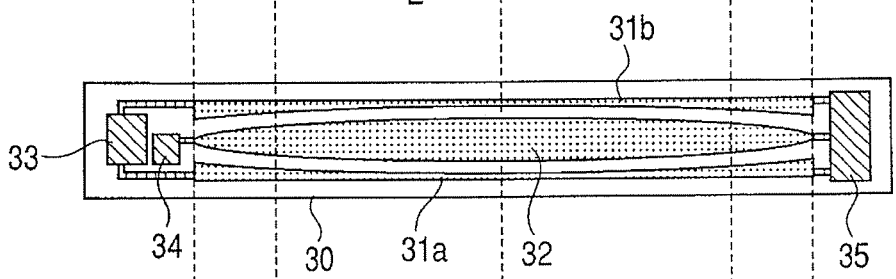
Figure 9C:
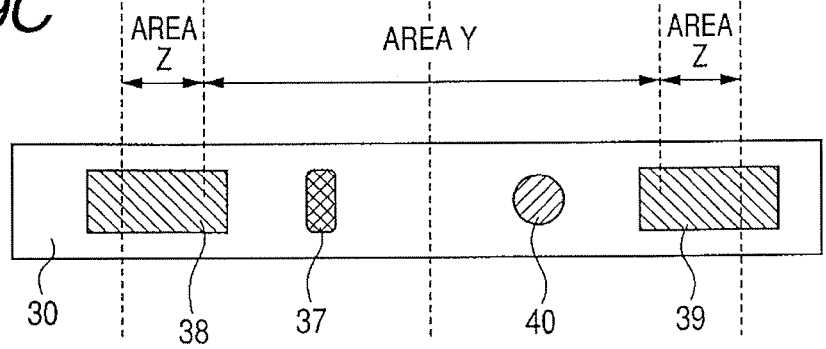

A heater 23 used in the second embodiment is shown in FIGS. 9A to 9D. FIG. 9A shows a sheet side surface of a heater, FIG. 9B shows a sheet side surface of a heater which does not have a protective layer like glass), FIG. 9C shows an opposite side surface of a heater. FIG. 9C shows a cross section of a heater whose lower side is a heat generating member side.

As shown in FIGS. 9A to 9D, the heater 23 used in the second embodiment comprises two first heat generating resistors 31 (31*a* and 31*b*) and a single second heat generating resistor 32, and each of the heat generating resistors 31 (31*a* and 31*b*) widened continuously from a longitudinal center E of a heater substrate toward both longitudinal ends thereof, thereby decreasing a heat generation amount gradually toward the longitudinal end. On the other hand, the heat generating resistor 32 is thinned continuously from the longitudinal center toward both longitudinal ends, thereby increasing a heat generation amount gradually toward the longitudinal end.

A main contact 33, a sub-contact 34 and a common contact 35 are formed as conductor patterns by a thick film printing technique, on a front surface of the heater substrate at both longitudinal end portions thereof. By changing the heat generation amount continuously in this way, the increase in temperature of a sheet non-passing portion of a fixing apparatus capable of handling various kinds of papers up to A3 size paper can be suppressed effectively.

A surface protection layer 36 is formed on the surface of the heater substrate 30 to cover or coat the first heat generating resistor 31, the second heat generating resistor 32, a part of the main contact 33, a part of the sun-contact 34 and a part of the common contact 35. The surface protection layer 36 is formed as a glass coat pattern by means of a thick film printing technique. The inner surface of the fixing film 24 is slidingly contacted with the surface of the surface protection layer 36.

The heater 23 includes substrate reinforcing members (substrate reinforcing layer) 38 and 39, and, in the illustrated embodiment, silver paste having high thermal conductivity is used as the surface reinforcing member 38 and 39.

Figure 10A:
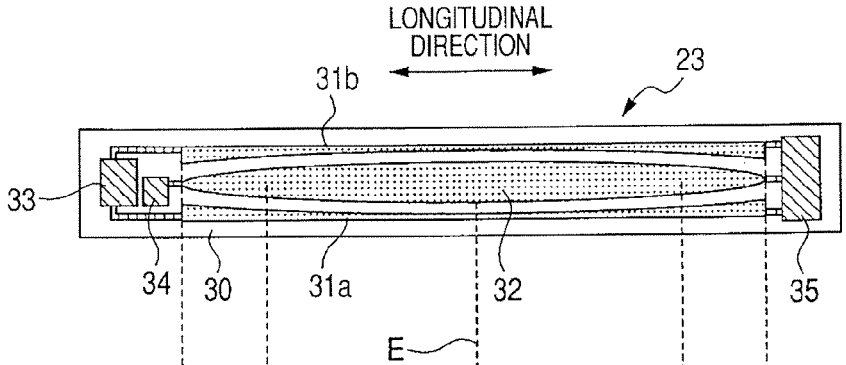
FIGS. 10A and 10B are views showing heat generation distribution of the heater of FIG. 9 in a longitudinal direction.
Figure 10B:
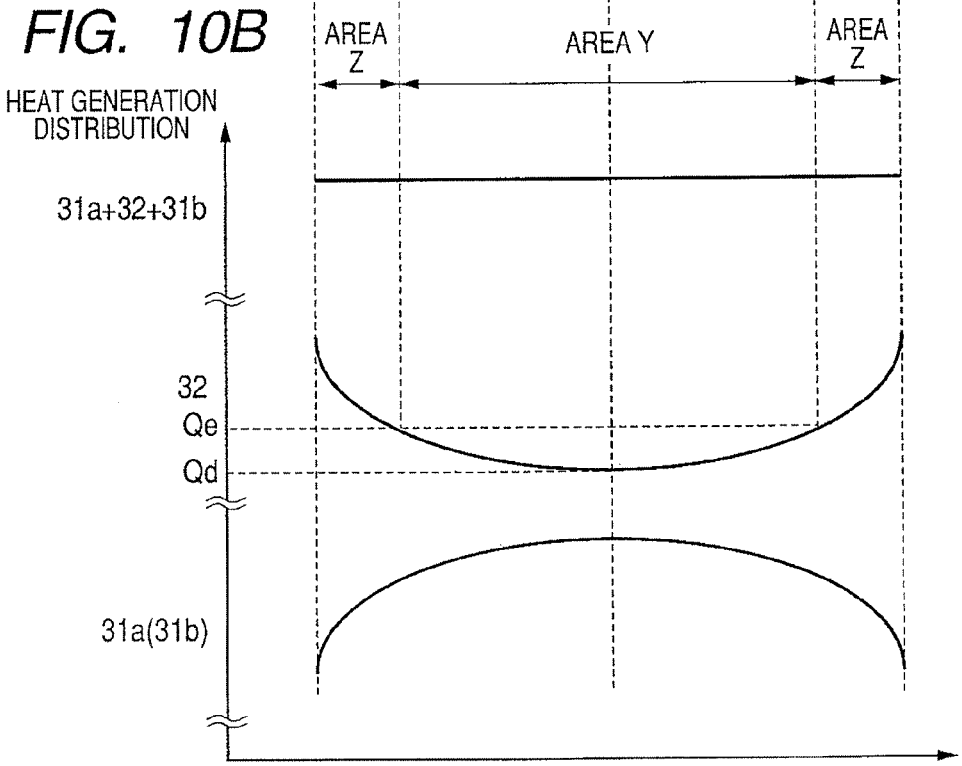
Figure 11A:
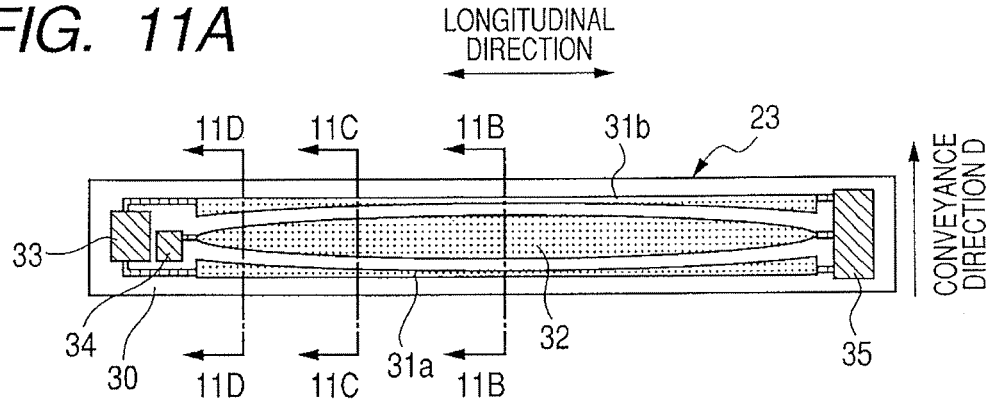
FIGS. 11A to 11D are views showing heat generation distributions of the heater of FIG. 9 in a width-wise direction, where
Figure 11B:
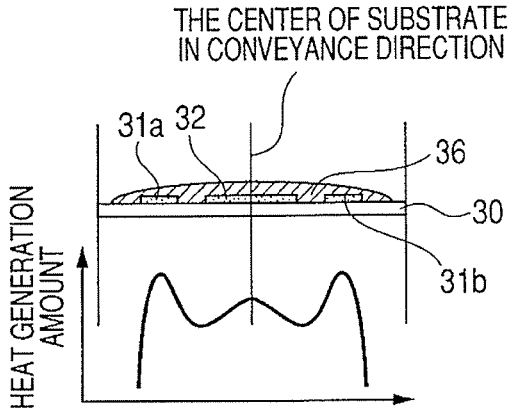
Figure 11C:
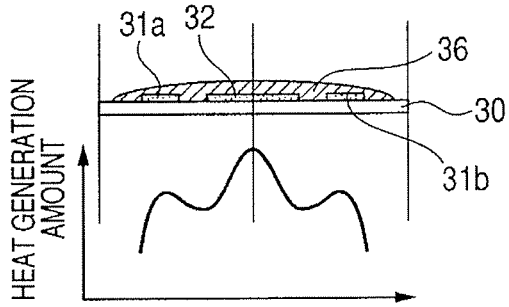
Figure 11D:
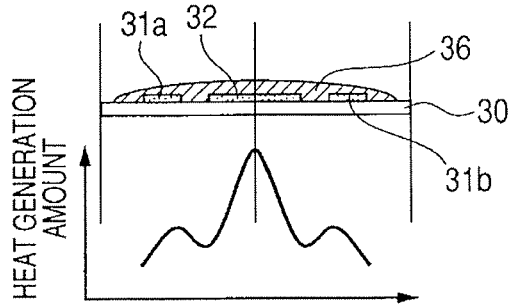
Figure 12A:
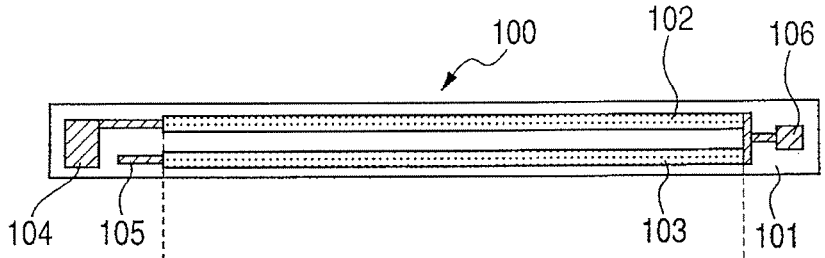
FIG. 12A is a schematic plan view of a front surface side of a conventional heater, showing configurations of heat generating resistors of the heater.
Figure 12B:
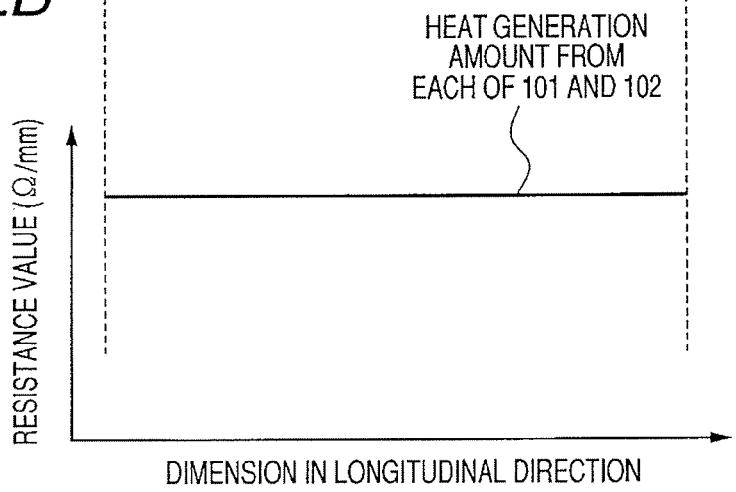
FIG. 12B is a view showing heat generation distribution in a longitudinal direction.
Figure 13A:
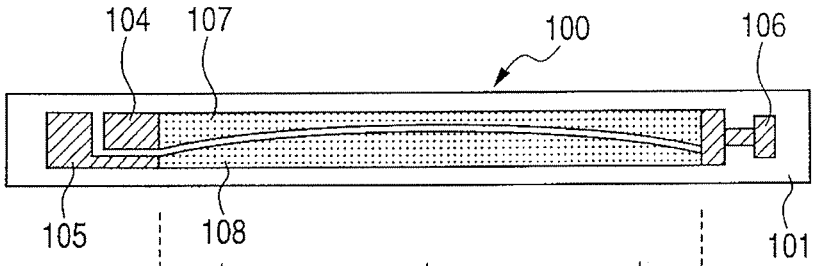
FIG. 13A is a schematic plan view of a front surface side of a conventional heater, showing configurations of heat generating resistors of the heater.
Figure 13B:
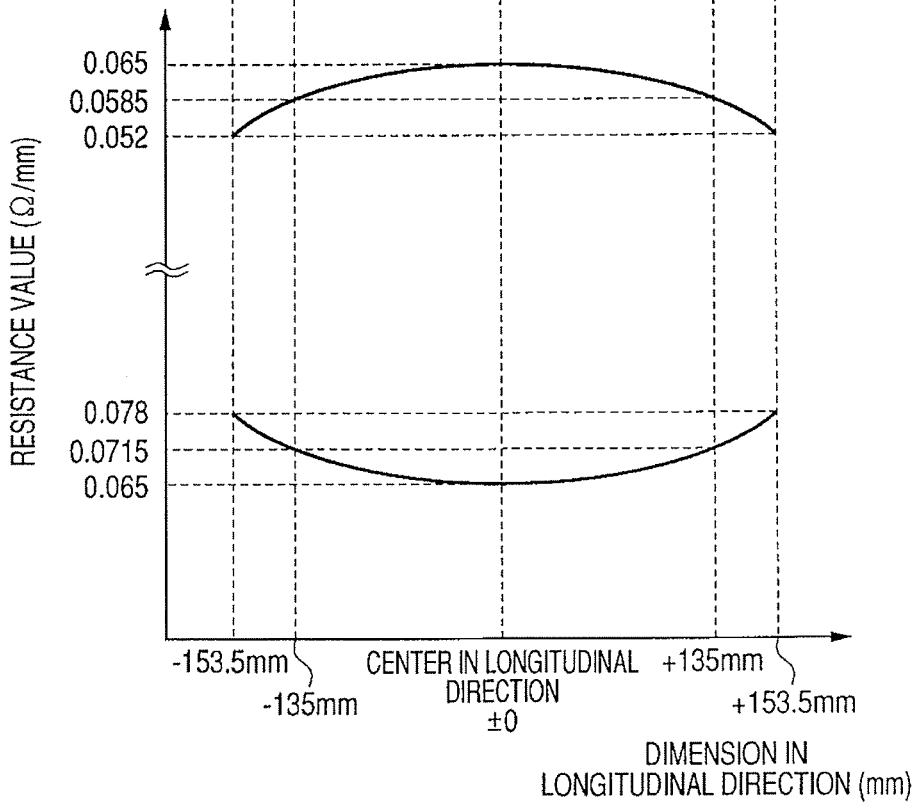
FIG. 13B is a view showing heat generation distribution in a longitudinal direction.

FIG. 10 shows heat generation distribution of the heater 23 in a longitudinal direction thereof. Further, FIGS. 11A to 11D show sections of the heater 23 according to the illustrated embodiment and heat generation distributions. FIGS. 11B, 11C and 11D are schematic views showing sections of the heater of FIG. 11A taken along the lines 11B-11B, 11C-11C and 11D-11D, respectively, and corresponding heat generation distributions. If the thermal overrun occurs in such a heater, the heater crack is generated at a position (section 11D-11D) where difference in heat generation amount between the longitudinal center and the longitudinal ends is great.

Figure 9D:
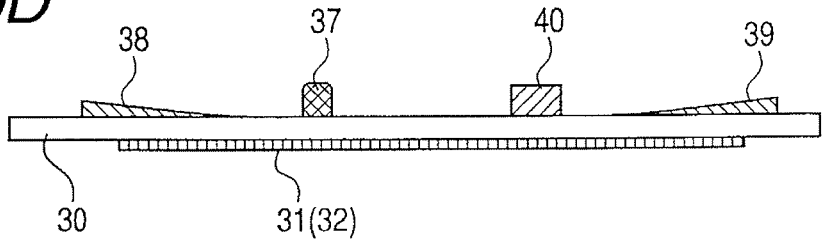

To avoid this, as shown in FIG. 9D, the substrate 30 includes the substrate reinforcing layers 38 and 39 disposed on a surface opposite to the surface on which the first and second heat generating resistors 31 and 32 are provided, along only parts of the longitudinal direction thereof, and, regarding the longitudinal direction of the substrate, coating areas of the substrate reinforcing layers include the second areas Z of the second heat generating resistor 32. In case of the illustrated embodiment, an area having a heat generation amount greater than Qe is defined as "area Z", where when it is assumed that a heat generation amount at a position E where the heat generation amount of the second heat generating resistor 32 is smallest is Qd and Qe=Qd×120%.

Further, in this embodiment, since the heat generation amount is changed continuously, thicknesses of the substrate reinforcing members 38 and 39 provided on the sheet non-passing surface, i.e. thicknesses of the silver pastes of the reinforcing members 38 and 39 are gradually increased from the longitudinal center toward the longitudinal ends. Namely, the thickness of the substrate reinforcing layer is changed in accordance with the resistance value per unit length of the second heat generating resistor 32.

With this arrangement, by increasing the thicknesses of the substrate reinforcing members 38 and 38 at positions where the heater crack is apt to occur and by decreasing the thicknesses of the substrate reinforcing members 38 and 38 at positions where thermal stress is small, the substrate 30 can be reinforced efficiently.

In fact, when the thermal overrun was generated in the heater according to this embodiment shown in FIG. 9, it was found that there is no area where strength is weakened, along the whole substrate.

As mentioned above, by using the heater 23 in which the heat generation amount is changed continuously along the longitudinal direction, the increase in temperature of the sheet non-passing portion of the heater can be suppressed, regarding all of sheet sizes. Further, by coating the silver paste having the high thermal conductivity on the high heat generation amount areas at the center of the recording material conveyance direction of the substrate 30 while continuously changing the thickness of the silver paste, the heater crack during the thermal overrun can be prevented.

The present invention is not limited to the illustrated embodiments, but includes all of alterations within the scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-030353, filed Feb. 7, 2006, which is hereby incorporated by reference herein in its entirety.

What is claimed is:

1. An image heating apparatus for heating an image formed on a recording material, comprising:

a heater including a ceramic substrate, wherein at least two first heat generating resistors and at least one second heat generating resistor are formed on a first surface of the substrate along a longitudinal direction thereof, and the second heat generating resistor is provided between the first heat generating resistors in a direction of a shorter side of the substrate;

wherein the second heat generating resistor includes a first region having a low resistance value per unit length and a second region having a resistance value per unit length higher than the resistance value of the first region;

a first switching element, which is connected electrically between a power source and said first heat generating resistors, for controlling an electrical power supply to said first heat generating resistors; and a second switching element, which is connected electrically between the power source and said second heat generating resistor, for controlling an electrical power supply to said second heat generating resistor;

wherein said heater has a substrate-reinforcing layer only along a portion of the longitudinal direction in a second surface opposite to the first surface of the substrate, and wherein the substrate-reinforcing layer is formed by coating the second surface with a material having thermal conductivity higher than a thermal conductivity of the substrate and an area of the substrate-reinforcing layer regarding the longitudinal direction includes all the second region of the second heat generating resistor, and at least a part of the first region of the second heat generating resistor is not included in the area of the substrate-reinforcing layer.

2. An image heating apparatus according to claim 1, wherein a thickness of the substrate-reinforcing layer is varied with the resisting value per unit length of said second heat generating resistor.

3. An image heating apparatus according to claim 1, wherein the first heat generating resistors are provided substantially symmetrically with respect to an approximate center in a shorter side direction of said substrate.

4. An image heating apparatus according to claim 3, wherein the second heat generating resistor is provided in one unit and is provided at the center.

5. An image heating apparatus according to claim 1, wherein the first heat generating resistor and the second heat generating resistor have different heat generation distributions.

6. An image heating apparatus according to claim 1, wherein further comprising a flexible sleeve of which an internal surface is in contact with the heater, and a pressure roller for forming a nip portion with the heater through said flexible sleeve, and, wherein the recording material is heated while being pinched and conveyed in the nip portion.

7. A heater for use in an image heating apparatus, comprising:

a ceramic substrate;

at least two first heat generating resistors formed on a first surface of said substrate along a longitudinal direction thereof; and at least one second heat generating resistor formed on the first surface of said substrate along a longitudinal direction thereof, said second heat generating resistor being provided between said first heat generating resistors in a direction of a shorter side of said substrate;

wherein said second heat generating resistor includes a first region having a low resistance value per unit length and a second region having a resistance value per unit length higher than the resistance value of the first region; and wherein said heater has a substrate-reinforcing layer only along a portion of the longitudinal direction in a second surface opposite to the first surface of the substrate, and wherein the substrate-reinforcing layer is formed by coating the second surface with a material having a thermal conductivity higher than a thermal conductivity of the substrate and an area of the substrate-reinforcing layer regarding the longitudinal direction includes all the second region of the second heat generating resistor, and at least a part of the first region of the second heat generating resistor is not included in the area of the substrate-reinforcing layer.

8. A heater according to claim 7, wherein a thickness of the substrate-reinforcing layer is varied with the resistance value per unit length of the second heat generating resistor.

9. A heater according to claim 7, wherein the first heat generating resistors are provided substantially symmetrically with respect to an approximate center in a short side direction of said substrate.

10. A heater according to claim 9, wherein the second heat generating resistor is provided in one unit and is provided at the center.

11. A heater according to claim 7, wherein the first heat generating resistor and said second heat generating resistor have different heat generation distributions.

* * * * *